US006079976A

United States Patent [19]

Nishiyama et al.

[11] Patent Number: 6,079,976

[45] Date of Patent: Jun. 27, 2000

[54] STRUCTURE FOR SUPPLY OF FUEL AND PILOT AIR

[75] Inventors: Tomohiko Nishiyama; Yusei Kusaka; Kazuhisa Mitani, all of Toyota, Japan

[73] Assignee: Toyota Jidosha Kabushiki Kaisha, Toyota, Japan

[21] Appl. No.: 08/861,317

[22] Filed: May 21, 1997

[30] Foreign Application Priority Data

May 22, 1996 [JP] Japan ..... 8-126195

[51] Int. Cl.[7] ..... F23D 14/58; F23D 11/16

[52] U.S. Cl. ..... 431/349; 431/187; 431/284; 239/422; 239/424; 239/549

[58] Field of Search ..... 431/349, 278, 431/215, 8, 187, 284, 285; 239/548, 549, 550, 551, 601, 422, 424, 425, 440; 432/180, 181

[56] References Cited

U.S. PATENT DOCUMENTS

| | | | |
|---|---|---|---|
| 2,073,448 | 3/1937 | Fruth et al. | 158/109 |
| 2,214,568 | 9/1940 | Thomas | 431/284 |
| 3,221,796 | 12/1965 | Nesbitt | 431/349 |
| 3,361,185 | 1/1968 | Anderson et al. | 158/7.5 |
| 3,455,514 | 7/1969 | Fenley, Jr. | 239/422 |
| 3,484,044 | 12/1969 | Dombruch et al. | 239/422 |
| 3,615,213 | 10/1971 | Shepherd | 431/349 |
| 3,844,704 | 10/1974 | Helke | 431/349 |
| 4,014,654 | 3/1977 | Howell | 431/187 |
| 4,120,639 | 10/1978 | Thekdi et al. | 431/158 |
| 4,197,076 | 4/1980 | Viger | 431/284 |
| 4,412,808 | 11/1983 | Sheppard et al. | 431/8 |
| 4,416,620 | 11/1983 | Morck | 431/187 |
| 4,428,727 | 1/1984 | Deussner et al. | 431/187 |
| 4,431,403 | 2/1984 | Nowak et al. | 431/284 |
| 4,648,361 | 3/1987 | Hales | 123/179 H |
| 4,726,760 | 2/1988 | Skoog | 431/8 |
| 5,145,359 | 9/1992 | Ancona et al. | 431/278 |
| 5,207,570 | 5/1993 | Voorheis | 431/188 |
| 5,217,363 | 6/1993 | Brais et al. | 431/187 |
| 5,431,147 | 7/1995 | Tanaka et al. | 431/215 |
| 5,667,376 | 9/1997 | Robertson et al. | 431/278 |

FOREIGN PATENT DOCUMENTS

| | | |
|---|---|---|
| 0 628 769 A1 | 12/1994 | European Pat. Off. . |
| 0 685 683 A1 | 12/1995 | European Pat. Off. . |
| 0 736 732 A1 | 10/1996 | European Pat. Off. . |
| 5-256423 | 10/1993 | Japan . |
| 6-221545 | 8/1994 | Japan . |
| WO 96/14540 | 5/1996 | WIPO . |

*Primary Examiner*—Ira S. Lazarus
*Assistant Examiner*—Josiah C. Cocks
*Attorney, Agent, or Firm*—Pillsbury Madison & Sutro LLP

[57] ABSTRACT

A pilot air passage, a pilot fuel passage and a main fuel passage are formed in a gun head for supplying pilot air and fuel. At least one of a flow amount detecting orifice, a flow amount adjusting needle valve and a pressure detecting plug is provided in each of the pilot air passage, the pilot fuel passage and the main fuel passage and is coupled to the gun head so as to be handled together with the gun head. A pilot air tube, a pilot fuel tube and a main fuel tube are constructed in the form of a triplet tube.

13 Claims, 4 Drawing Sheets

STRUCTURE FOR SUPPLY OF FUEL AND PILOT AIR

This application is based on application No. HEI 8–126195 filed in Japan on May 22, 1996, the content of which is incorporated herein by reference.

BACKGROUND OF THE INVENTION

1. Field of the Invention

The present invention relates to a fuel and pilot air structure applicable to a burner used in various types of industrial furnaces. The industrial furnaces may include a boiler.

2. Description of Related Art Japanese Patent Publication No. HEI 5–256423 discloses a fuel supply structure for use in a regenerative combustion type burner. In the structure, as illustrated in a left half portion of FIG. 3, flow amount detecting sensors 5', 8'and 11', flow amount controlling valves 6', 9'and 12'and pressure detecting sensors 7', 10'and 13'are provided outside of and separately from a burner including a fuel and air supply gun head 1'.

However, the conventional structure has the following problems:

First, when a burner is mounted to a wall of a furnace, a large space has to be prepared for installation of those sensors and control devices in addition to a space for installation of the burner. Further, installation of the sensors and control devices is labor intensive.

Second, in the conventional structure, it is difficult to direct fuel and supply air to the desired location and to obtain sufficient ignition.

SUMMARY OF THE INVENTION

An object of the present invention is to provide a structure for supplying fuel and pilot air which is easy to install and facilitates combustion adjustments.

Another object of the present invention is to provide a structure for supplying fuel and pilot air which stabilizes combustion as well as facilitating installation and combustion adjustments.

Structural features according to the present invention are as follows:

(1) A structure for supplying fuel and pilot air according to the present invention includes a gun head for supplying fuel and pilot air (hereinafter, a gun head), and at least one of a flow amount detecting orifice, a flow amount adjusting needle valve and a pressure detecting plug. The gun head includes a pilot air passage, a pilot fuel passage and a main fuel passage formed therein. The pilot air passage, the pilot fuel passage and the main fuel passage are independent of each other due to their respective seals. At least one of the flow amount detecting orifice, the flow amount adjusting needle valve and the pressure detecting plug is provided in each of the pilot air passage, the pilot fuel passage and the main fuel passage and is coupled to the gun head so as to be handled together with the gun head. For example, in the form that at least a portion of each of the flow amount detecting orifice, the flow amount adjusting needle valve and the pressure detecting plug is housed in the gun head.

(2) A structure according to the above-described feature (1), wherein the gun head includes a triplet tube therein. The triplet tube includes a pilot air tube, a pilot fuel tube disposed within the pilot air tube and a main fuel tube disposed within the pilot fuel tube.

(2-1) A structure according to the above-described feature (2), wherein a heat-resistant electrical insulator is disposed between the pilot air tube and the pilot fuel tube.

(2-2) A structure according to the above-described feature (2), wherein at an exit of the pilot air tube, first nozzles defined by a spline mechanism, each having a rectangular cross-section, and second nozzles, each having a circular cross-section, are alternately arranged in a circumferential direction of the pilot air tube.

(2-3) A structure according to the above-described feature (2), wherein the pilot fuel tube has a plurality of apertures formed therein. The apertures include a most upstream group of apertures and at least one remaining group of apertures spaced from the most upstream group of apertures in an axial direction of the pilot fuel tube. The most upstream group of apertures are located in the vicinity of a pilot air exit of the pilot air tube.

(2-4) A structure according to the above-described feature (2), wherein the main fuel tube has a flame maintaining plate configured in the form of a flange and protruding radially outwardly from an outside surface of the main fuel tube.

(2-5) A structure according to the above-described feature (2), wherein a hood which extends from a downstream end of the pilot air tube in a downstream direction is provided.

(2-6) A structure according to the above-described feature (2-5), wherein the hood includes a protrusion protruding radially inwardly.

According to the feature (1), since the flow amount detecting orifice, the flow amount adjusting needle valve and the pressure detecting plug are integral with the gun head, installation of a burner to a wall of a furnace and adjustment of combustion are easy.

According to the feature (2), since a pilot flame is generated downstream of the gun head and the main fuel is supplied to a core of the pilot flame, the combustion is stable.

According to the feature (2-1), the ignition is stable. According to the feature (2-2), a spark is generated uniformly in a circumferential direction so that the ignition is stable and directivity of the flame is improved. According to the feature (2-3), the pilot flame is generated uniformly in a circumferential direction and the ignition is stable. According to the features (2-4), (2-5) and (2-6), the flame is prevented from being blown out.

BRIEF DESCRIPTION OF THE DRAWINGS

The above and other objects, features, and advantages of the present invention will become more apparent and will be more readily appreciated from the following detailed description of the preferred embodiments of the present invention in conjunction with the accompanying drawings, in which.

DETAILED DESCRIPTION OF THE PREFERRED EMBODIMENT

Figure 1:
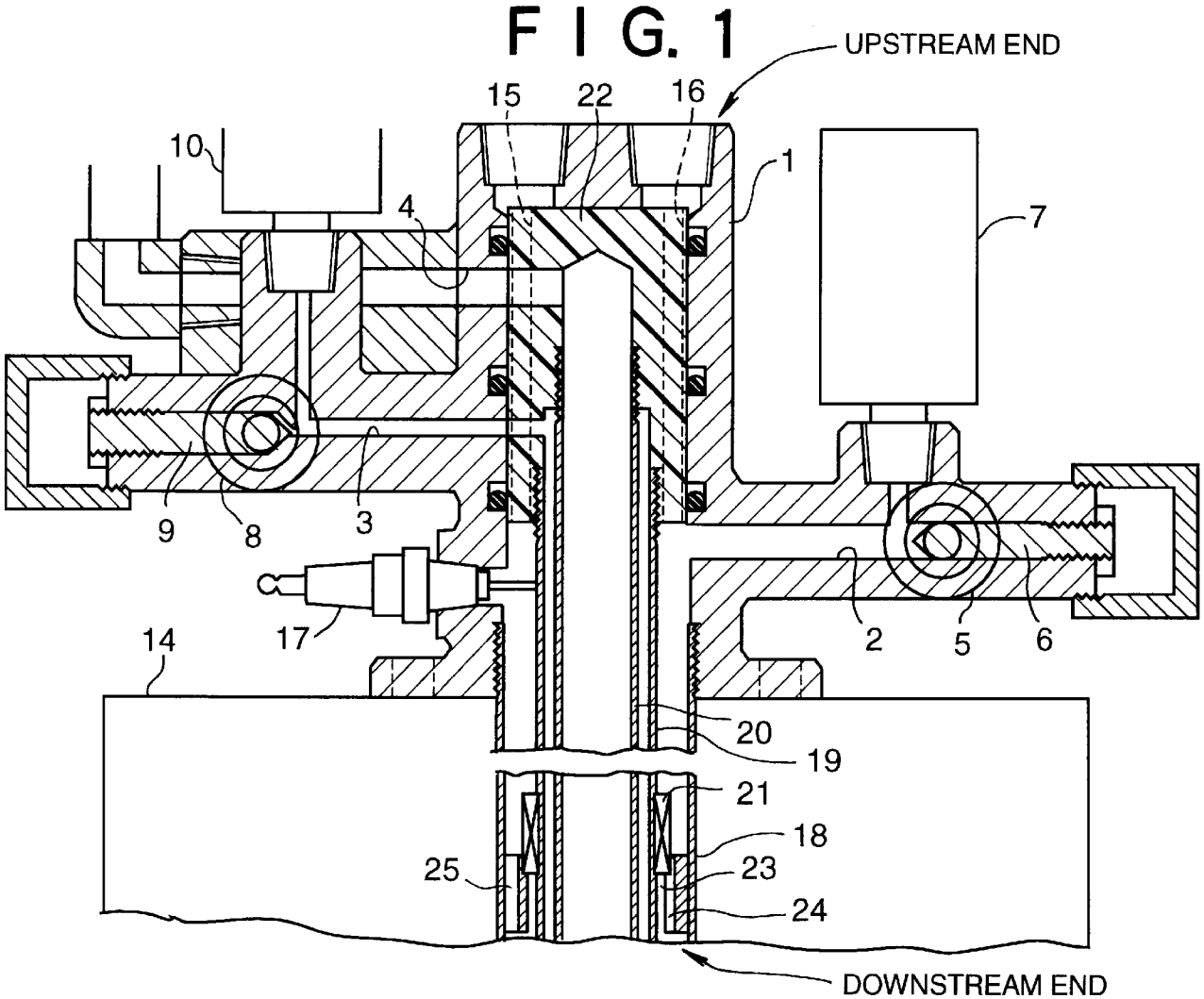
FIG. 1 is a cross-sectional view of a structure for supply of fuel and pilot air according to one embodiment of the present invention.
Figure 2:
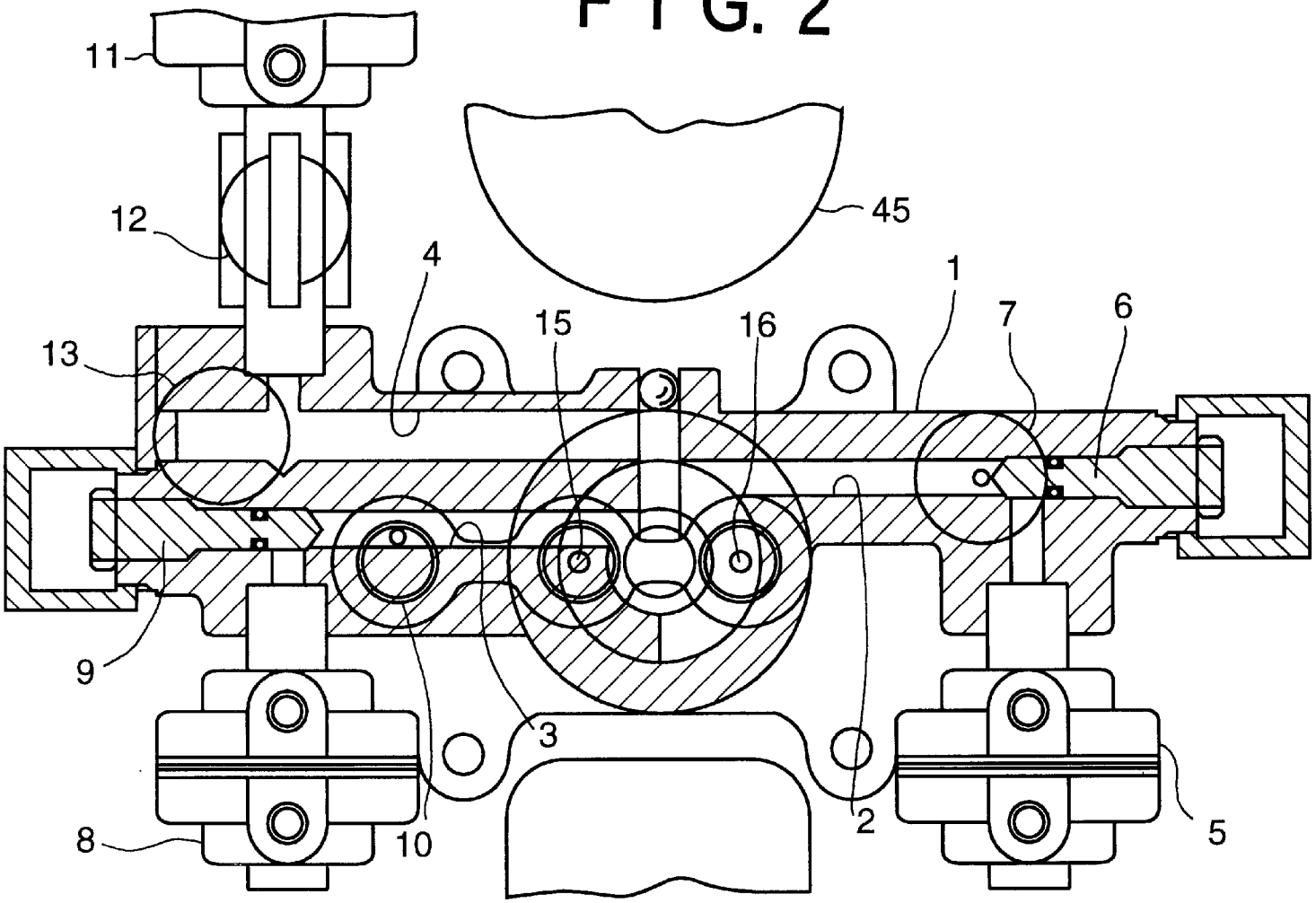
FIG. 2 is a transverse cross-sectional view of the structure of FIG. 1.
Figure 3:
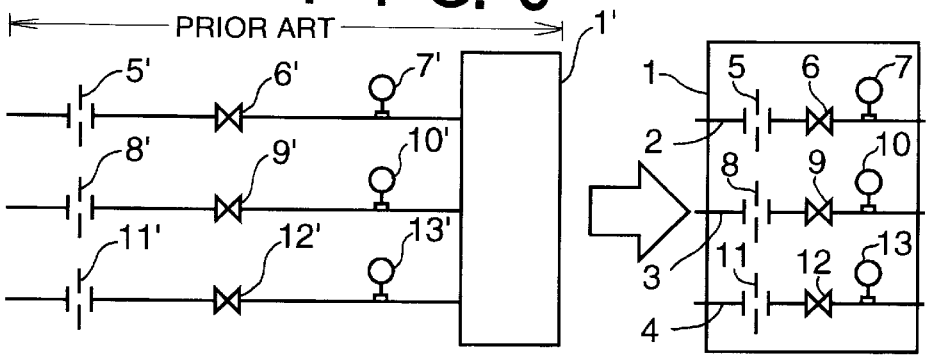
FIG. 3 is a schematic system diagram illustrating a relationship between a gun head and detecting and adjusting devices in the structure according to the embodiment of the present invention, and a relationship between a gun head and detecting and adjusting devices in a conventional structure for comparison.

As illustrated in FIGS. 1 –3, in a structure for supplying fuel and pilot air according to one embodiment of the present invention, a pilot air passage 2, a pilot fuel passage 3 and a main fuel passage 4 are formed in a gun head 1 for supplying fuel and pilot air (hereinafter, a gun head 1). The pilot air passage 2, the pilot fuel passage 3 and the main fuel passage 4 are independent of each other due to their respective seals.

In the pilot air passage 2, at least one of a flow amount detecting orifice 5, a flow amount adjusting needle valve 6 and a pressure detecting plug 7 is provided in that order in a pilot air flow direction.

Similarly, in the pilot fuel passage 3, at least one of a flow amount detecting orifice 8, a flow amount adjusting needle valve 9 and a pressure detecting plug 10 is provided in that order in a pilot fuel flow direction.

Further, in the main fuel passage 4, at least one of a flow amount detecting orifice 11, a flow amount adjusting needle valve 12 and a pressure detecting plug 13 is provided in that order in a main fuel flow direction.

The flow amount detecting orifices 5, 8 and 11, the flow amount adjusting needle valves 6, 9 and 12 and the pressure detecting plugs 7, 10 and 13 are coupled to the gun head 1 so as to be handled together with the gun head 1, for example, in the form that at least a portion of each of the flow amount detecting orifices 5, 8 and 11, the flow amount adjusting needle valves 6, 9 and 12 and the pressure detecting plugs 7, 10 and 13 is housed in the gun head 1.

Figure 6:
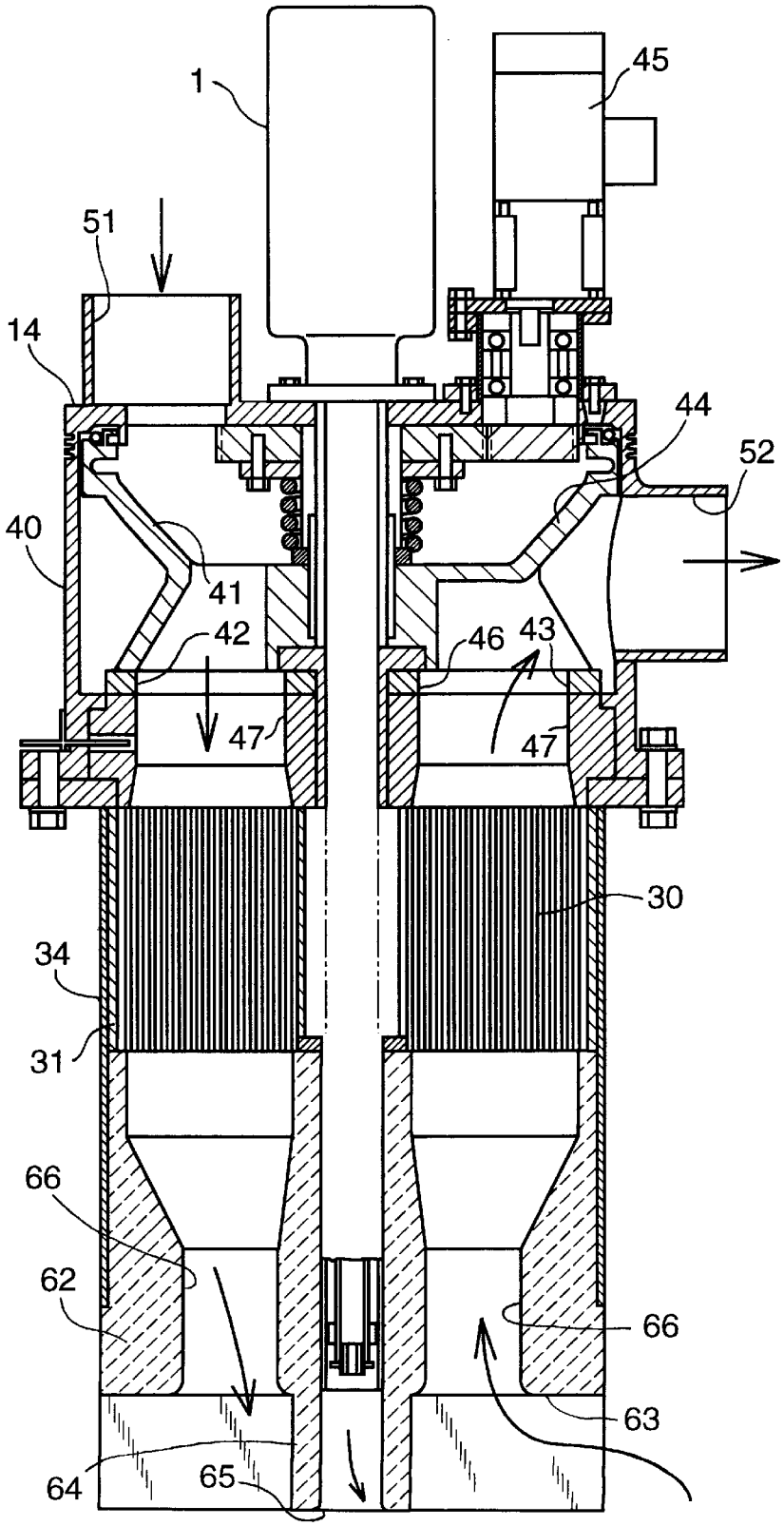
FIG. 6 is a cross-sectional view of a regenerative combustion type single burner to which the structure according to the embodiment of the present invention is applied.

The right half portion of FIG. 3 illustrates that each of the flow amount detecting orifices 5, 8 and 11, the flow amount adjusting needle valves 6, 9 and 12 and the pressure detecting plugs 7, 10 and 13 is housed in the gun head 1, and for comparison, a left half portion of FIG. 3 illustrates that each of the flow amount detecting orifices, the flow amount adjusting needle valves and the pressure detecting plugs is disposed outside the gun head in the conventional burner. The gun head 1 is coupled to a burner 14, which may be a regenerative combustion type burner as shown in FIG. 6 or one of various types of industrial burners, together with the orifices, the valves and the plugs housed in the gun head 1. During maintenance, the gun head 1 is removed from the gun head 1 together with the orifices, the valves and the plugs housed in the gun head 1.

As can be best viewed in FIGS. 1 and 2, the gun head 1 includes a sight hole 15 formed therein for monitoring an ignition state therethrough. The sight hole 15 extends straight in the axial direction of the gun head 1.

Further, the gun head 1 includes a hole 16 for installing at least a portion of an ULTRAVISION for detecting a flame generated by the structure. The hole 16 extends straight in the axial direction of the gun head 1.

Further, the gun head 1 houses therein at least a portion of an ignition plug 17 for electric ignition. The ignition plug 17 extends perpendicularly to the axial direction of the gun head 1. The ignition plug 17 contacts a pilot fuel tube at a tip of the ignition plug 17.

Figure 4:
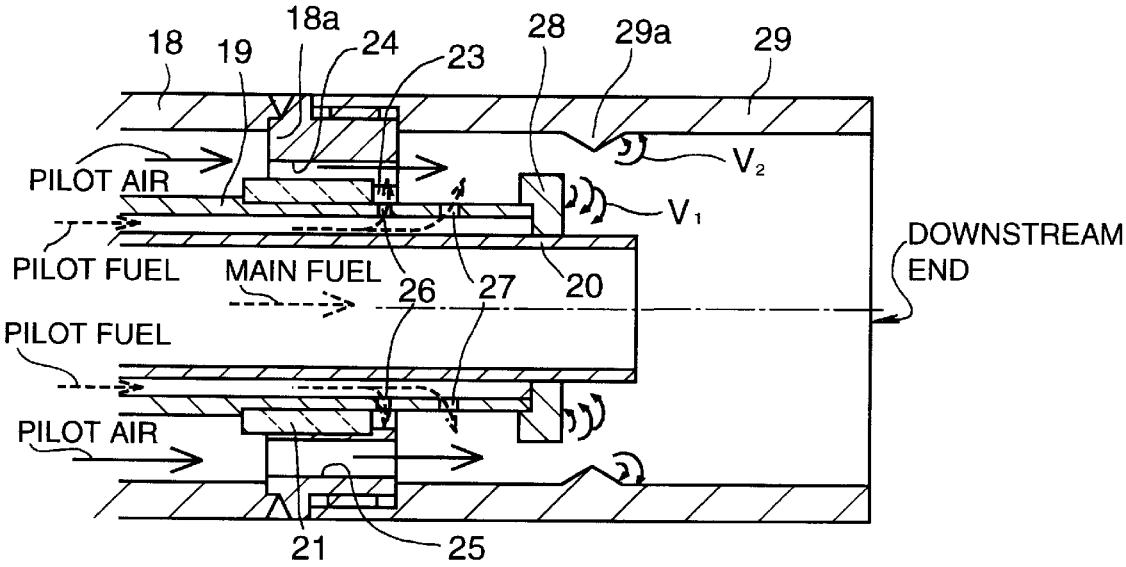
FIG. 4 is a cross-sectional view of a triplet tube portion of the structure according to the embodiment of the present invention.
Figure 5:
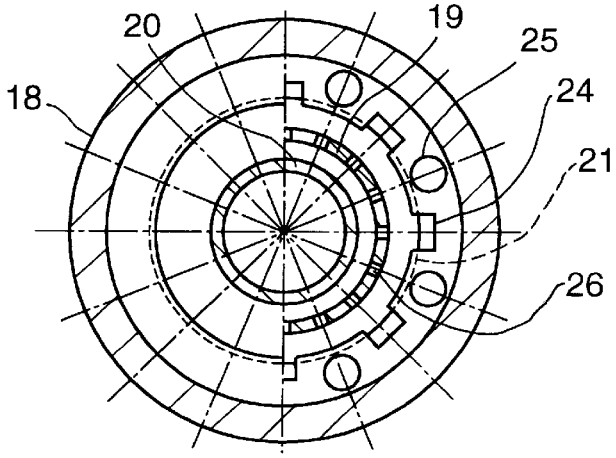
FIG. 5 is a plan view of the portion of FIG. 4.

As illustrated in FIGS. 4 and 5, the gun head 1 includes a triplet tube therein. The triplet tube includes a pilot air tube 18, a pilot fuel tube 19 disposed within the pilot air tube 18 and a main fuel tube 20 disposed within the pilot fuel tube 19.

As can be best seen illustrated in FIG. 1, a portion of the pilot air passage 2 is formed between the pilot air tube 18 and the pilot fuel tube 19. A portion of the pilot fuel passage 3 is formed between the pilot fuel tube 19 and the main fuel tube 20. A portion of the main fuel passage 4 is formed within the main fuel tube 20.

The structure further includes a heat-resistant electric insulator 21 made from, for example, a ceramic and disposed between the pilot air tube 18 and the pilot fuel tube 19, and a member 22 made from resin for electrically insulating the pilot air tube 18 and the pilot fuel tube 19 from each other at an upstream of the electric insulator 21. Due to this structure and a high electrical voltage from the ignition plug 17, an electric spark is generated at a spark portion 23 between the pilot air tube 18 and the pilot fuel tube 19 to ignite fuel.

As illustrated in FIGS. 4 and 5, at an exit of the pilot air tube 18, a plurality of first nozzles 24 each having a rectangular cross-section and a plurality of second nozzles 25 each having a circular cross-section are formed. The first nozzles 24 are formed by a spline formed in a radially inner portion of a radially inwardly protruding member 18*a* (a part of the tube 18) fixed to the pilot air tube 18, and the second nozzles 25 are formed in the member 18*a*. The first nozzles 24 and the second nozzles 25 are alternately arranged in a circumferential direction of the pilot air tube 18. The first nozzles 24 and the second nozzles 25 extend in the axial direction of the pilot air tube 18 and afford an axial directivity to the flow of pilot air when the pilot air flows through the nozzles 24 and 25.

The pilot fuel tube 19 includes pilot fuel exits formed in a wall of the pilot fuel tube 19 downstream of the electric insulator 21. The pilot fuel exits include a plurality of apertures formed in the wall of the pilot fuel tube 19. The apertures include a most upstream group of apertures 26 and the remaining group or groups of apertures 27 spaced from the most upstream group of apertures in the axial direction of the pilot fuel tube 19. The most upstream group of apertures 26 are located at a pilot air exit of the pilot air tube, more particularly, in the vicinity of the nozzles 24 having a rectangular cross-section so that each aperture 26 corresponds to each nozzle 24. Due to this structure, the pilot fuel is expelled into the pilot air passage 2 uniformly in the circumferential direction of the pilot fuel tube 19.

The main fuel tube 20 has a flame maintaining plate 28 configured in the form of a flange and protruding radially outwardly from an outside surface of the main fuel tube 20 to radially outside of an outside surface of the pilot fuel tube 19. The plate 28 is located at the downstream end of pilot fuel passage 3. The plate 28 generates vortices V1 downstream of and the vicinity of the plate 28, and the vortices maintain or hold the flame in the form of a ring along the inside surface of the pilot air tube 18. The flame helps to stabilize propagation of combustion from a pilot flame to a main flame.

A hood 29 is connected to a downstream end of the pilot air tube 18 and extends downstream to a position downstream of the pilot air exit (the nozzles 24 and 25). A flame does not disperse due to the hood 29, so that the interior of the hood 29 is maintained at a high temperature and propagation of combustion from the pilot flame to the main flame is stabilized.

A protrusion 29*a* (a part of the hood 29) is formed at an inside surface of the hood 29 so as to protrude radially inwardly. The protrusion 29*a* has a tapered portion, the surface of which obliquely extends radially inwardly and in a downstream direction. The tapered surface directs the pilot flame and the burned gas obliquely inwardly so that propagation of the pilot flame to the main flame is stabilized.

FIG. 6 illustrates a regenerative combustion type single burner. The regenerative combustion type burner includes a casing 34, a heat storage member 30 (made from, for example, a ceramic) having many passages and housed in a cylinder 31 disposed within the casing 34, a burner tile 62 disposed on one axial side of the heat storage member 30, and an air supply and gas exhaust switching mechanism 40 disposed on an opposite axial side of the heat storage member 30.

The heat storage member 30 retrieves heat of exhaust gas when the exhaust gas passes through the heat storage member 30 to lower the temperature of the exhaust gas to about 250 ° C. The heat stored by the member 30 is released to supply air when the supply air passes through the heat storage member 30 thereby raising the temperature of the supply air to about 900 ° C. The gas passing area of the heat storage member 30 is divided into a plurality of sections in a circumferential direction of the heat storage member 30. When exhaust gas flows through some of the sections, supply air flows through the remaining sections. Switching between air supply and gas exhaust is conducted by the switching mechanism 40.

The burner tile 62 is made from ceramics or heat-resistant metals and includes a protrusion protruding from an air supply and gas exhaust surface 63. A fuel release surface 65 is formed at a portion connecting an inside surface of the protrusion and a front end surface of the protrusion. A plurality of air supply and gas exhaust holes 66 are formed in the burner tile and are open to the air supply and gas exhaust surface 63. The air supply and gas exhaust holes 66 correspond to the sections of the heat storage member 30 in the circumferential direction of the burner. Therefore, when exhaust gas flows through a part of the holes 66, supply air flows through the remaining part of the holes 66.

The switching mechanism 40 includes a rotatable member 44, a stationary member 46 and a partition 41. The stationary member 46 includes a plurality of apertures 47 which are located so as to correspond to the sections of the heat storage member 30 in the circumferential direction of the burner. The rotatable member 44 has an opening 42 located on one side of the partition 41 and another opening 43 located on another side of the partition 41. The opening 42 communicates with an air supply opening 51 of the burner and the opening 43 communicates with a gas exhaust opening 52 of the burner. The rotatable member 44 is rotated in one direction or opposite directions by a drive device 45 (an electric motor or an air cylinder). Air supply and gas exhaust are switched by causing the aperture 47 which had coincided with the opening 42 to coincide with the opening 43 and causing the aperture 47 which had coincided with the opening 43 to coincide with the opening 42.

Next, the operation of the device according to the invention will be explained.

In the structure of FIGS. 1–3, since the flow amount detecting orifices 5, 8 and 11, the flow adjusting needle valves 6, 9 and 12, and the pressure detecting plugs 7, 10 and 13 are integrally installed in the gun head 1, those orifices, valves and plugs can be mounted to the burner body 14 only by installing the gun head 1 to the burner body 14 so that the installation work is very simple and space for providing those orifices, valves and plugs is greatly reduced. In addition, maintenance of the orifices, valves and plugs is easy, whereby cost reductions are achieved.

Further, since the sight hole 15 is provided, the ignition condition can be visually monitored through the sight hole 15 while adjusting combustion.

The ULTRAVISION 16 also allows flame detection.

Further, since high electrical voltage is imposed to the pilot fuel tube 19 using the ignition plug 17, an electric spark can be generated between the pilot air tube 18 and the pilot fuel tube 19 to thereby ignite the pilot fuel.

In the structure of FIGS. 4 and 5, since the triplet tube including the pilot air tube 18, the pilot fuel tube 19 and the main fuel tube 20 is provided, a pilot flame is formed in the vicinity of the pilot fuel exit of the pilot fuel tube, and main fuel is expelled to the core portion of the pilot flame, so that the pilot flame surrounds the main flame to thereby stabilize combustion.

Since the pilot air tube 18 and the pilot fuel tube 19 are insulated from each other by the insulator 21 at the downstream portion thereof and by the resin member 22 at the upstream thereof, and a spark portion 23 protruding radially inwardly is provided at the inside surface of the pilot air tube 18, an electric spark is generated between the spark portion 23 and the pilot fuel tube 19 so that a stable ignition to the pilot fuel and formation of a pilot flame are possible.

Since the pilot air exit includes the nozzles 24, each having a rectangular cross-section, and the nozzles 25, each having a circular cross-section, and those nozzles 24 and 25 are arranged alternately and uniformly in the circumferential direction of the pilot air tube 18, a spark is generated uniformly in the circumferential direction and is stable. More particularly, since the spark tends to be generated at shortest distance portions between the spline portion of the pilot air tube 18 and the pilot fuel tube 19 and the shortest distance portions are arranged at constant intervals over the entire circumference, the chance of a spark, and therefore the occurrence of sparks, are uniform in the circumferential direction.

Pilot air passing through the rectangular nozzles 24 is supplied to the spark generating portion to stabilize ignition. Pilot air passing through the circular nozzles 25 gives the pilot flame a directivity and enables perfect combustion of the pilot flame.

Since the upstream group of apertures 26 are arranged at equal intervals in the circumferential direction of the pilot fuel tube 19, the pilot fuel is expelled substantially uniformly over the entire circumference of the pilot tube and a fuel-rich area is formed at the spark generating portion. As a result, an electrical spark characteristic of the space increases so that a strong and uniform spark is generated over the entire circumference. The pilot fuel expelled through the most upstream group of apertures 26 mixes with a portion of the pilot air, to be stably ignited.

From the downstream apertures 27 also the pilot fuel is expelled substantially uniformly over the entire circumference of the pilot fuel tube 19. The pilot fuel mixes with pilot air at a relatively large range, so that a mixture uniform in the circumferential direction is obtained and the pilot flame is uniform over the entire circumference of the pilot fuel tube 19.

Since the flame maintaining plate 28 is formed at the outside surface of the main fuel tube 20, a portion of the pilot air expelled from the rectangular nozzles 25 is intercepted by the plate 28, whereby a uniform and fuel-rich mixture is formed upstream of the plate 28 and vortices V1 are generated downstream of the plate 28 to hold the flame. As a result, the flame is prevented from being blown out.

Since the hood 29 is provided at the downstream end of the pilot air tube 18, the temperature of the interior of the hood 29 rises to maintain the flame.

Further, since the protrusion 29*a* is formed in the inside surface of the hood 29, the pilot air flow is directed obliquely inwardly so that vortices generated downstream of the plate 28 are strengthened. Vortices V2 are further generated downstream of the protrusion 29*a* so that the pilot flame is further held along the inside surface of the hood. Furthermore, since the pilot air flow is directed obliquely inwardly, a portion of the main fuel and a portion of the pilot air are mixed with each other, the main fuel is activated and the combustion is stabilized.

According to the present invention, the following technical advantages are obtained:

First, since the passages are formed in the gun head and the orifices, the valves and plugs are integrally installed in the gun head, the installation work is easy and the installation space is saved.

Second, in the case where the sight hole is provided, an ignition condition can be confirmed by sight.

Third, in the case where the ULTRAVISION is provided, detection of the flame is possible.

Fourth, in the case where the ignition plug is provided, electric ignition is possible.

Fifth, in the case where the fuel and pilot air passage structure is formed in a triplet tube, the pilot fuel flow, the main fuel flow and the pilot air flow can be controlled independently of each other.

Sixth, in the case where the pilot air tube and the pilot fuel tube are insulated from each other by the heat-resistant insulator, despite generation of a spark downstream thereof and close thereto, the insulator can endure the high temperature due to the spark.

Seventh, in the case where the rectangular nozzles are arranged at equal intervals in the circumferential direction, generation of sparks and the generated pilot flame are uniform over the entire circumference. Further, in the case where the circular nozzles are provided, directivity of the pilot flame is enhanced.

Eighth, in the case in which the most upstream group of apertures are provided, a gas-rich area can be formed whereby spark generation is easy. In the case in which a downstream group or groups of apertures are provided, the pilot flame is uniform in the circumferential direction.

Ninth, in the case the flame maintaining plate is provided, vortices are generated downstream of the plate whereby the pilot flame is effectively maintained.

Tenth, in the case where the hood is provided, the temperature of the interior of the hood is high so that the pilot flame is effectively maintained.

Last, in the case where the protrusion is formed at the inside surface of the hood, vortices are generated downstream of the protrusion also, so that the pilot flame is further effectively maintained. Further, since the pilot flame is directed obliquely inwardly by the protrusion, the main fuel is activated and combustion is stable.

Although the present invention has been described with reference to specific exemplary embodiments, it will be appreciated by those skilled in the art that various modifications and alterations can be made to the particular embodiments shown without materially departing from the novel teachings and advantages of the present invention. Accordingly, it is to be understood that all such modifications and alterations are included within the spirit and scope of the present invention as defined by the following claims.

What is claimed is:

1. A structure constructed and arranged to supply fuel and pilot air comprising:

a gun head constructed and arranged to supply fuel and pilot air, said gun head including a pilot air passage, a pilot fuel passage and a main fuel passage formed therein, said pilot air passage, said pilot fuel passage and said main fuel passage being isolated from each other by respective seals; and a first assembly provided in said pilot air passage a second assembly provided in said pilot fuel passage, and a third assembly provided in said main fuel assembly, said first passage including one or more of a flow amount detecting orifice, a flow amount adjusting needle valve or a pressure detecting plug, said second assembly including one or more of a flow amount detecting orifice, a flow amount adjusting needle valve or a pressure detecting plug, and said third assembly including one or more of a flow amount detecting orifice, a flow amount adjusting needle valve or a pressure detecting plug, each of said first assembly, said second assembly and said third assembly being mounted to said gun head so as to be handled together with said gun head.

2. A structure constructed and arranged to supply fuel and pilot air comprising:

a gun head constructed and arranged to supply fuel and pilot air, said gun head including a pilot air passage, a pilot fuel passage and a main fuel passage formed therein, said pilot air passage, said pilot fuel passage and said main fuel passage being isolated from each other by respective seals, said gun head having a triplet tube therein, said triplet tube including a pilot air tube forming at least a portion of said pilot air passage, a pilot fuel tube forming at least a portion of said pilot fuel passage and being disposed within said pilot air tube and a main fuel tube forming at least a portion of said main fuel passage and being disposed within said pilot fuel tube; and a first assembly provided in said pilot air passage, a second assembly provided in said pilot fuel passage, and a third assembly provided in said main fuel passage, said first assembly including one or more of a flow amount detecting orifice, a flow amount adjusting needle valve or a pressure detecting plug, said second assembly including one or more of a flow amount detecting orifice, a flow amount adjusting needle valve or a pressure detecting plug, and said third assembly including one or more of a flow amount detecting orifice, a flow amount adjusting needle valve or a pressure detecting plug, each of said first assembly, said second assembly and said third assembly being coupled to said gun head so as to be handled together with said gun head.

3. The structure according to claim 2, wherein said gun head includes a sight hole formed therein constructed and arranged to monitor an ignition state therethrough.

4. The structure according to claim 2, wherein said gun head houses therein at least a portion of an ignition plug for electric ignition.

5. The structure according to claim 2, further comprising:

a heat-resistant electric insulator disposed between said pilot air tube and said pilot fuel tube; and a member made from resin for electrically insulating said pilot air tube and said pilot fuel tube from each other at an upstream end of said electric insulator.

6. The structure according to claim 2, further comprising:

a plurality of first nozzles each having a rectangular cross-section and located at an exit of said pilot air tube; and a plurality of second nozzles each having a circular cross-section and located at the exit of said pilot air tube, wherein said first nozzles and said second nozzles are alternately arranged in a circumferential direction of said pilot air tube.

7. The structure according to claim 2, wherein said pilot fuel tube has a plurality of apertures formed therein, said apertures including an upstream group of apertures and at least one remaining group of apertures spaced from said upstream group of apertures in an axial direction of said pilot fuel tube in a downstream direction, said upstream group of apertures being located in the vicinity of a pilot air exit of said pilot air tube.

8. The structure according to claim 2, wherein said main fuel tube has a flame maintaining plate configured in the form of a flange and protruding radially outwardly from an outside surface of said main fuel tube.

9. The structure according to claim 2, further comprising a hood extending from a downstream end of said pilot air tube in a downstream direction.

10. The structure according to claim 9, wherein said hood includes a protrusion projecting radially inwardly.

11. The structure according to claim 5, further comprising:

a plurality of first nozzles each having a rectangular cross-section located at an exit of said pilot air tube; and a plurality of second nozzles each having a circular cross-section located at the exit of said pilot air tube, wherein said first nozzles and said second nozzles are alternately arranged in a circumferential direction of said pilot air tube.

12. The structure according to claim 5, wherein said pilot fuel tube has a plurality of apertures formed therein, said apertures including an upstream group of apertures and at least one remaining group of apertures spaced from said upstream group of apertures in an axial direction of said pilot fuel tube in a downstream direction, said upstream group of apertures being located in the vicinity of a pilot air exit of said pilot air tube.

13. The structure according to claim 8, wherein said hood includes a protrusion projecting radially inwardly.

* * * * *